US008745908B2

(12) United States Patent
Hansen

(10) Patent No.: US 8,745,908 B2
(45) Date of Patent: Jun. 10, 2014

(54) INDEX TAB HOLDER

(76) Inventor: Merrill Hansen, New Hope, MN (US)

( * ) Notice: Subject to any disclaimer, the term of this patent is extended or adjusted under 35 U.S.C. 154(b) by 0 days.

(21) Appl. No.: 13/227,930

(22) Filed: Sep. 8, 2011

(65) Prior Publication Data

US 2012/0047780 A1 Mar. 1, 2012

Related U.S. Application Data

(63) Continuation of application No. 12/011,497, filed on Jan. 28, 2008, which is a continuation of application No. 11/152,034, filed on Jun. 14, 2005, now Pat. No. 7,334,363.

(60) Provisional application No. 60/579,698, filed on Jun. 15, 2004.

(51) Int. Cl.
*G09F 23/10* (2006.01)
*B42F 11/00* (2006.01)

(52) U.S. Cl.
CPC *G09F 23/10* (2013.01); *B42F 11/00* (2013.01)
USPC ..... 40/641; 40/772; 40/626; 40/611.1; 40/611.13; 40/771; 40/761; 40/765; 40/359; 40/661; 211/162; 229/67.1; 229/67.2

(58) Field of Classification Search
CPC ..... G09F 23/10; B42F 21/00
USPC ..... 40/641, 661, 359, 772, 626, 611.1, 40/611.13, 771, 761, 765; 211/162; 229/67.1, 67.2
See application file for complete search history.

(56) References Cited

U.S. PATENT DOCUMENTS

| | | | | |
|---|---|---|---|---|
| 2,601,026 | A | 6/1952 | Jones | |
| 3,062,217 | A * | 11/1962 | Woodhouse, Jr | 40/652 |
| 3,244,179 | A * | 4/1966 | Porteous et al. | 211/162 |
| 3,507,063 | A * | 4/1970 | Jochheim | 40/641 |
| 4,477,013 | A | 10/1984 | Herrin | |
| 4,660,855 | A * | 4/1987 | Pagliaccio | 281/2 |
| 6,332,285 | B1 * | 12/2001 | Aaldenberg et al. | 40/641 |

* cited by examiner

*Primary Examiner* — Syed A Islam

(57) ABSTRACT

Index tab holders are movably mounted on top portions of file folders or data separation sheets to locate the tab holders in selected lateral locations without removing the tab holders from the file folders. Linear rails associated with the top portions of the file folders cooperate with ribs on the tab holders to mount and laterally guide the tab holders on the file folders.

18 Claims, 16 Drawing Sheets

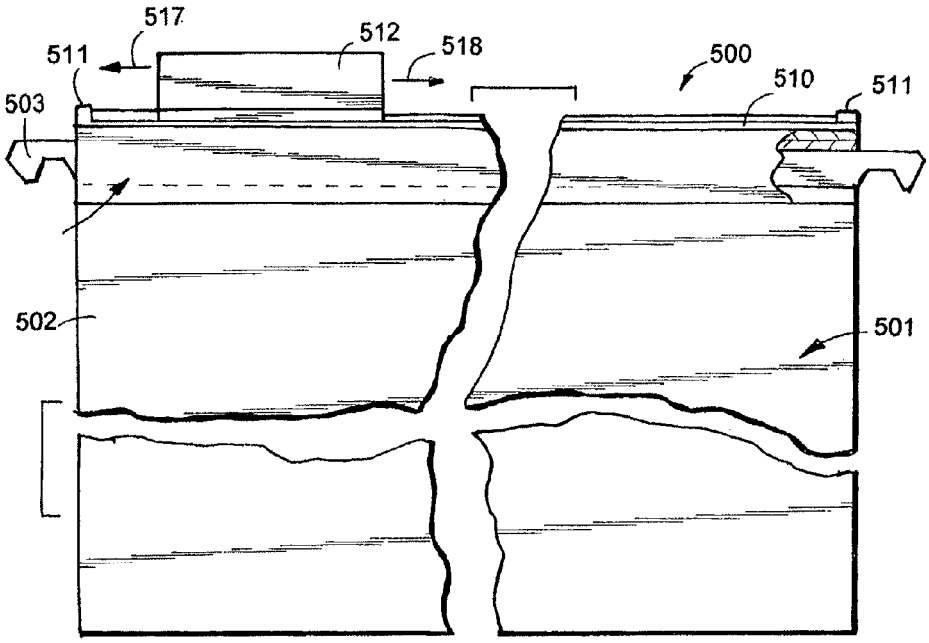
FIG. 34
FIG. 35
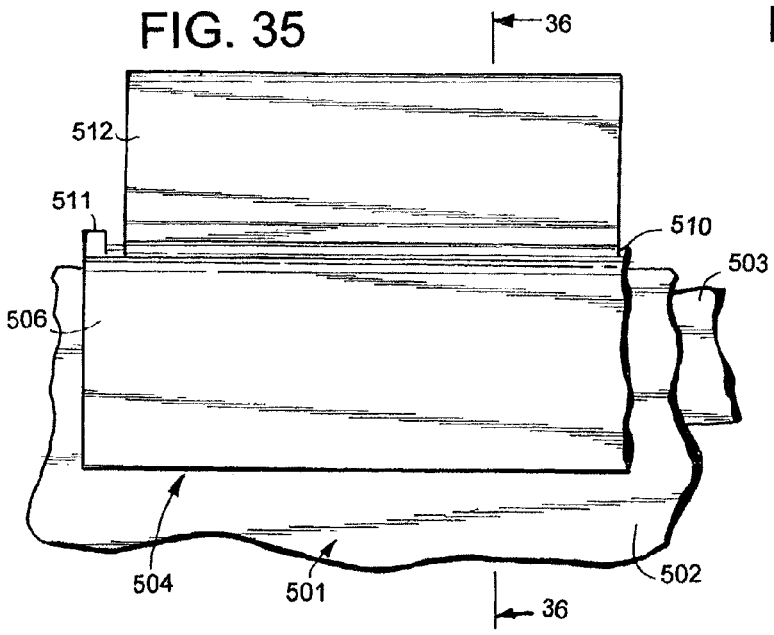
FIG. 36
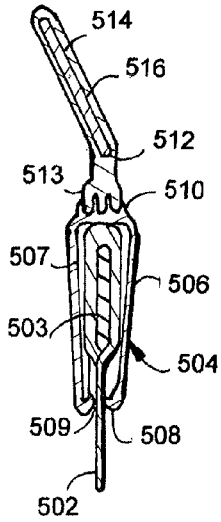

INDEX TAB HOLDER

CROSS REFERENCE TO RELATED APPLICATION

This application claims the priority of priority to U.S. Non-Provisional application Ser. No. 12/011,497 filed Jan. 28, 2008 entitled Index Tab Holder, which application claims priority to U.S. Non-Provisional application Ser. No. 11/152,034 filed Jun. 14, 2005 entitled Index Tab Holder, now U.S. Pat. No. 7,334,363, which application claims priority to U.S. Provisional Patent Application Ser. No. 60/579,698 filed Jun. 15, 2004, the contents of which are hereby incorporated by reference herein in their entireties.

FIELD OF THE INVENTION

The invention relates to suspension file folders with index tab holders and index tabs for use on file folders and data separation sheet members. The index tab holders can be positioned in selected locations on top sections of the file folders.

BACKGROUND OF THE INVENTION

Hanging file folders have support bars with downwardly open hooks on opposite ends to support the folders on horizontal rails of a file drawer. Folded paper sheet members have top sections turned over the bars to retain the bars on the sheet members. The top sections are provided with laterally spaced slots to accommodate index tab holders in selected positions along the top sections of the file folders. The index tab holders have end fingers that must be inserted into the slots in the file folders to mount the index tab holders on the file folders. The number and location of the slots limit the locations of the index tab holders relative to the top of the file folders. The end fingers must be removed from the slots of the file folder and inserted into different slots to reposition the index tab holder on the file holder. This is a tedious and time consuming work when a number of file drawers require repositioning of index tab holders. An example of an index tab holder having lateral ears insertable into slots in top sections of file folders is disclosed by J. R. Wyant in U.S. Pat. No. 5,311,685.

Index tab holders mountable on file folders in predetermined positions determined by slots, holes or protrusions on the top sections of file folders are disclosed in U.S. Pat. Nos. 2,644,089; 3,244,170; 3,238,947 and 3,263,688. A positionable index tab along the top of a file folder having a projection or detent to establish an interference fit on a file folder is described by E. R. Aaldenberg et al in U.S. Pat. No. 6,332,285. The detent can cooperate with holes in the file folder to locate the index tab in selected positions on the file folder.

SUMMARY OF THE INVENTION

The invention comprises an index tab holder for a document file, note books, and data separation sheet members that can be laterally repositioned without removal of the index tab holder from the file folder, note book and data separation sheet members. The index tab holders have removable transparent sheet members that retain index tabs on the index tab holders. The transparent sheet members can be removed from the holders and replaced on the holders from file folders. The invention includes combined file folders and index tab holders. The file folders have rail and rib members that accommodate index tab holders and allow lateral movement of the index tab holders along the top of the file folders. The index tab holders can be horizontally repositioned on the file folders without removing the tab holders from the file folders.

DESCRIPTION OF THE DRAWINGS

FIG. 34 is a fragmentary front elevational view of another modification of a file folder with an index tab holder mounted thereon;

FIG. 35 is an enlarged front elevational view of the index tab holder of FIG. 34;

FIG. 36 is a sectional view taken along line 36-36 of FIG. 34;

DESCRIPTION OF PREFERRED EMBODIMENTS

Figure 1:
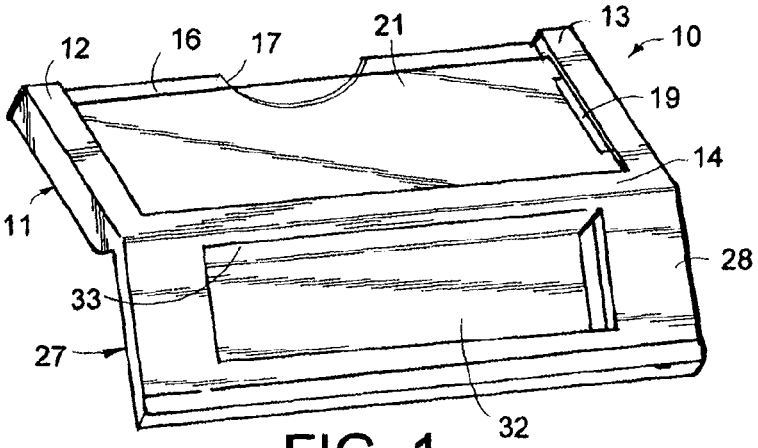
FIG. 1 is a perspective view of an index tab holder for a file folder embodying the present invention.
Figure 2:
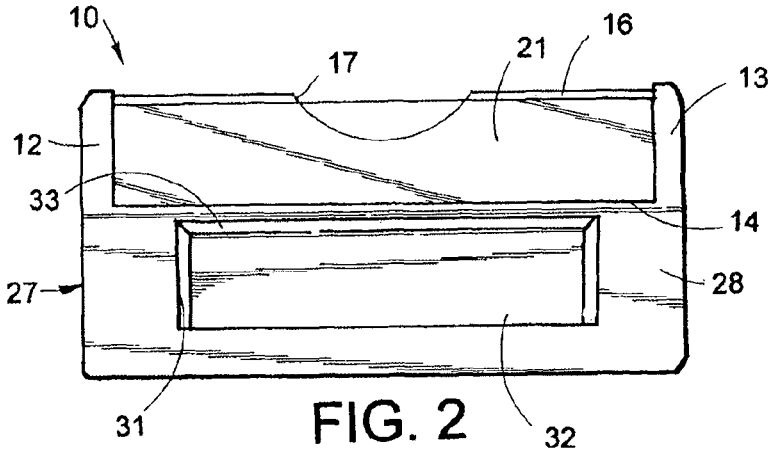
FIG. 2 is a front elevational view thereof.
Figure 3:
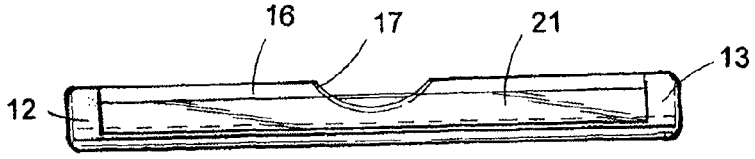
FIG. 3 is a top plan view thereof.
Figure 4:
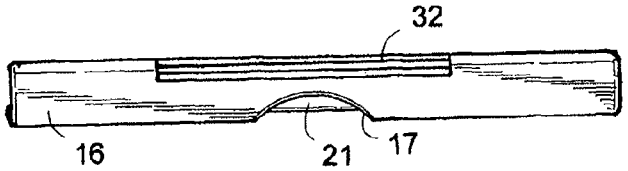
FIG. 4 is a bottom plan view thereof.
Figure 5:
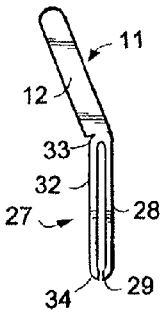
FIG. 5 is a side elevational view thereof.
Figure 6:
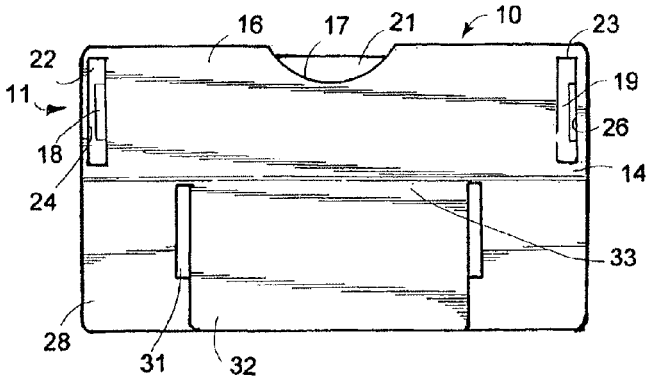
FIG. 6 is a rear elevational view thereof.
Figure 7:
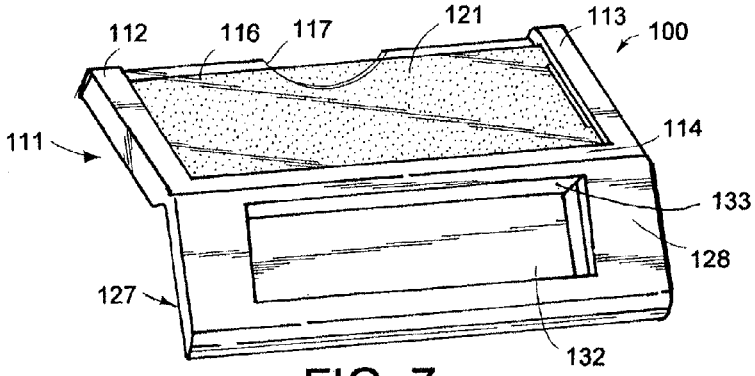
FIG. 7 is a perspective view of a first modification of the index tab holder of FIG. 1.
Figure 8:
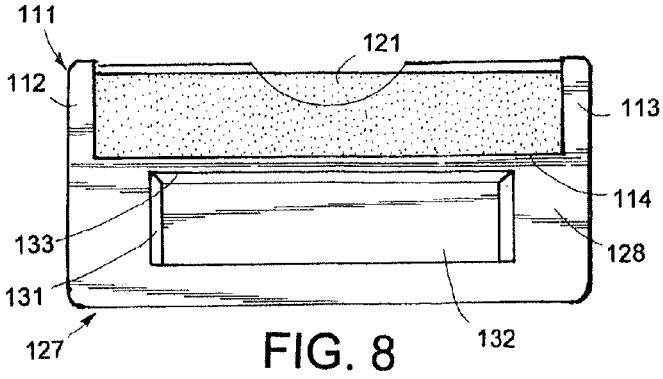
FIG. 8 is front elevational view of FIG. 7.
Figure 9:
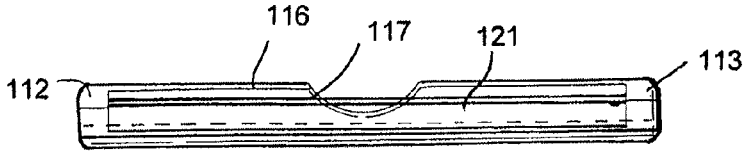
FIG. 9 is a top plan view of FIG. 7.
Figure 10:
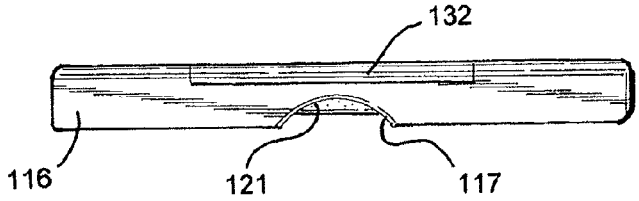
FIG. 10 is a bottom plan view of FIG. 7.
Figure 11:
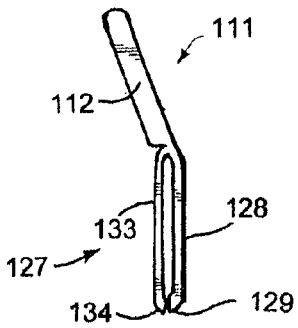
FIG. 11 is a side elevational view of FIG. 7.
Figure 12:
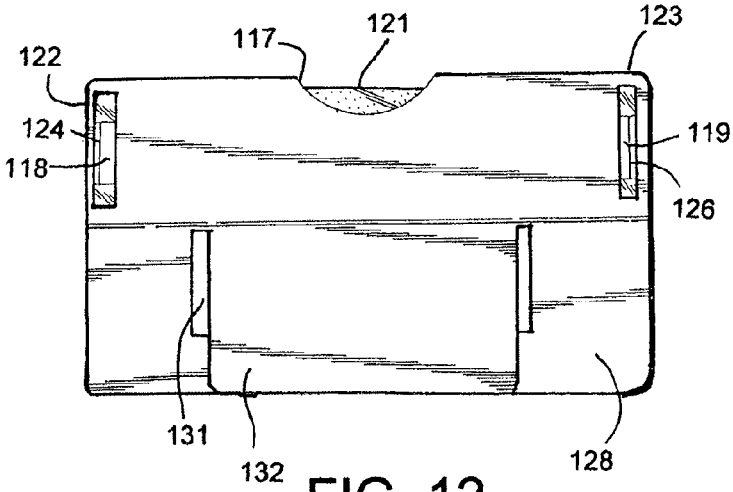
FIG. 12 is a rear elevational view of FIG. 7.
Figure 13:
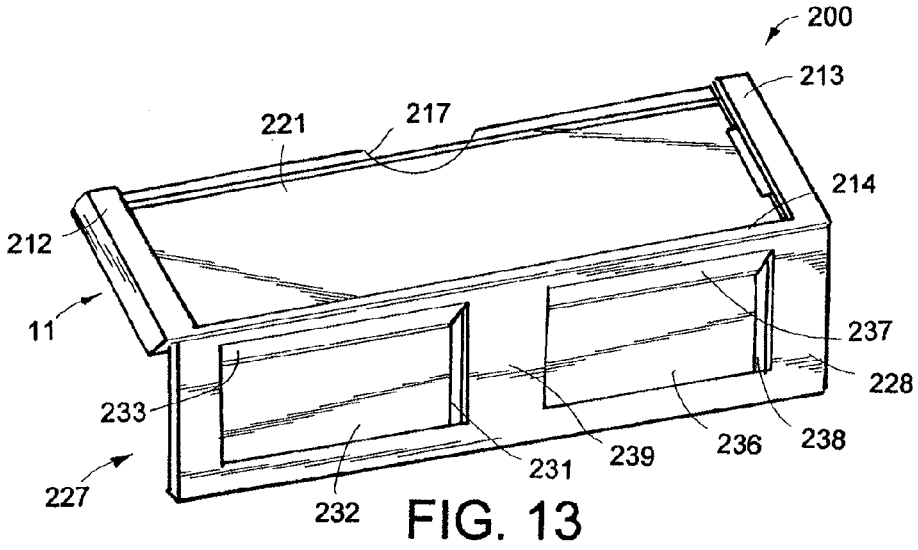
FIG. 13 is a perspective view of a second modification of the index tab holder of FIG. 1.
Figure 14:
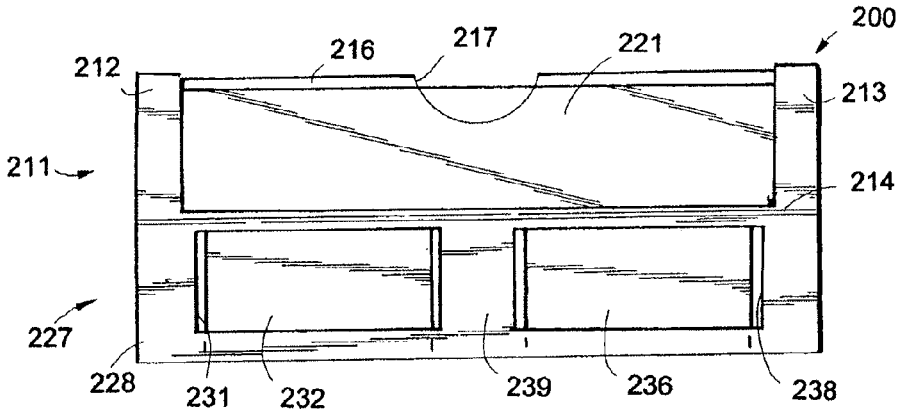
FIG. 14 is a front elevational view of FIG. 13.
Figure 15:
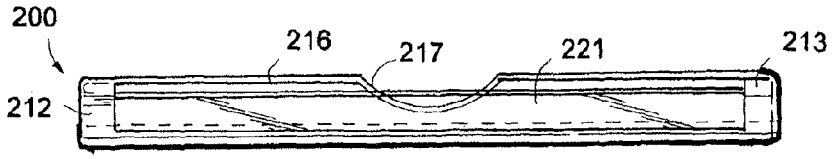
FIG. 15 is a top plan view of FIG. 13.
Figure 16:
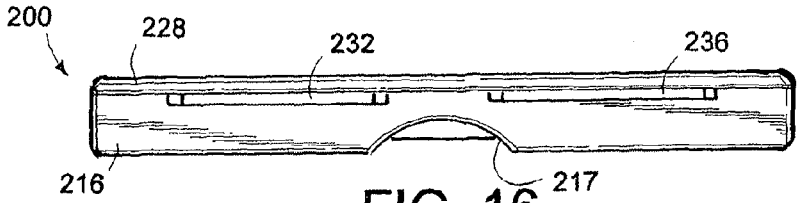
FIG. 16 is a bottom plan view of FIG. 13.
Figure 17:
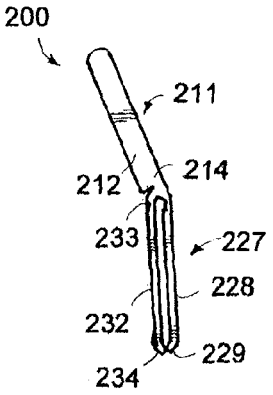
FIG. 17 is a side elevational view of FIG. 13.
Figure 18:
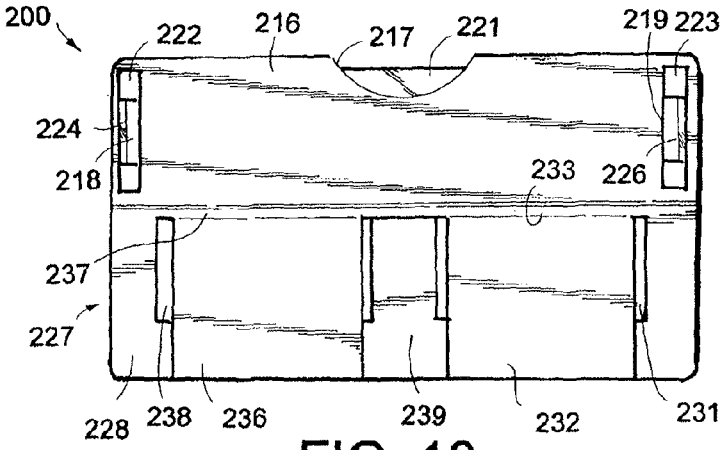
FIG. 18 is a bottom plan view of FIG. 13.
Figure 19:
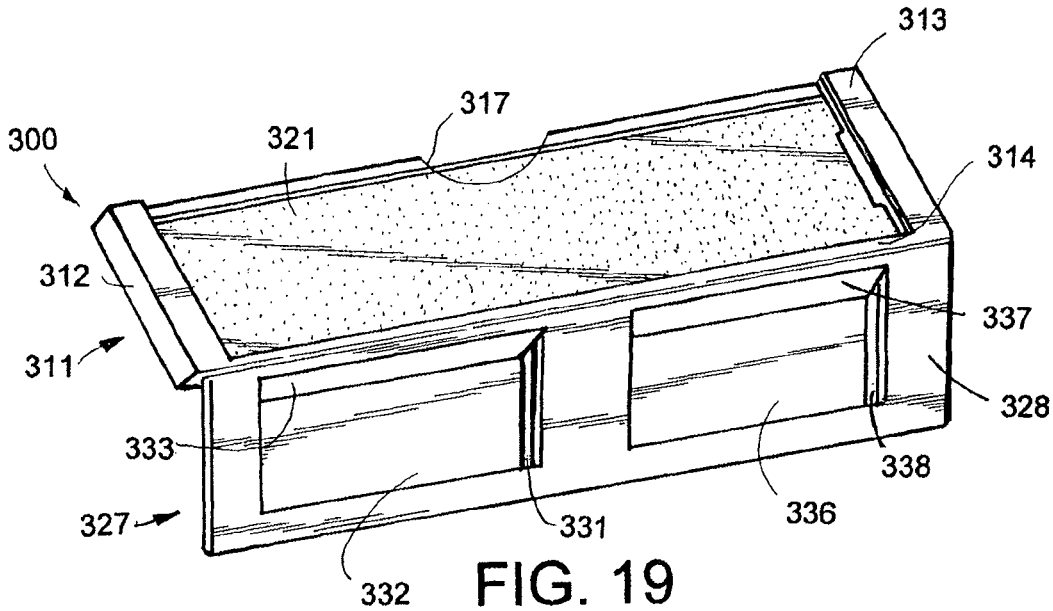
FIG. 19 is a perspective view of a third modification of the index tab holder of FIG. 1.
Figure 20:
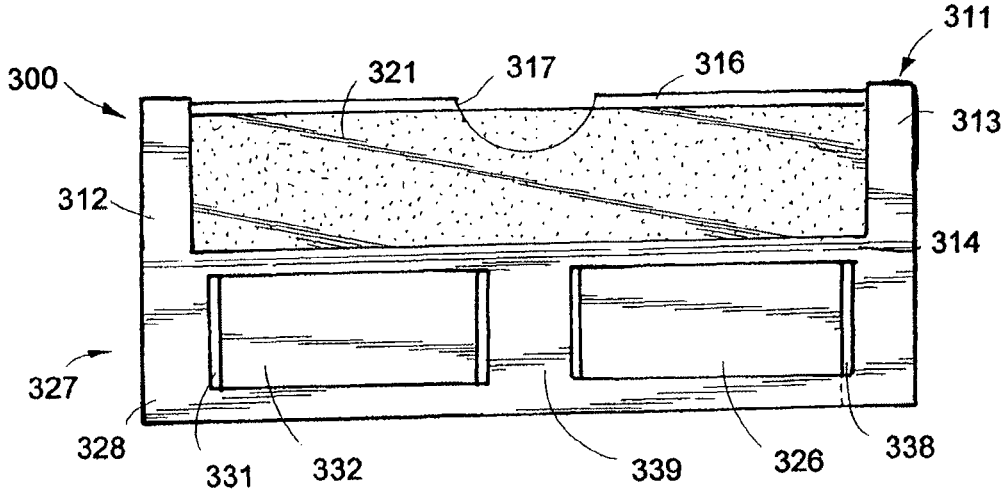
FIG. 20 is a front elevational view of FIG. 19.
Figure 21:
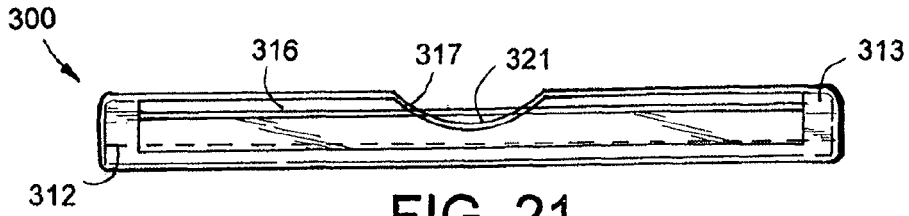
FIG. 21 is a top plan view of FIG. 19.
Figure 22:
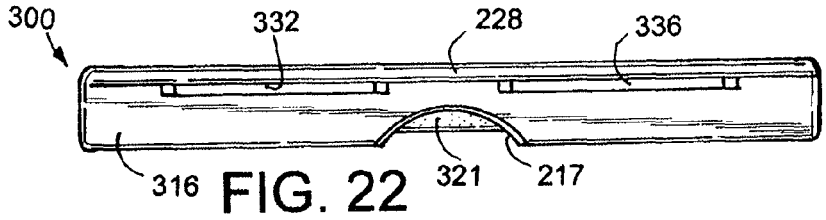
FIG. 22 is a bottom plan view of FIG. 19.
Figure 23:
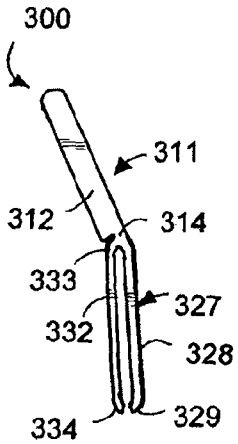
FIG. 23 is a side elevational view of FIG. 19.
Figure 24:
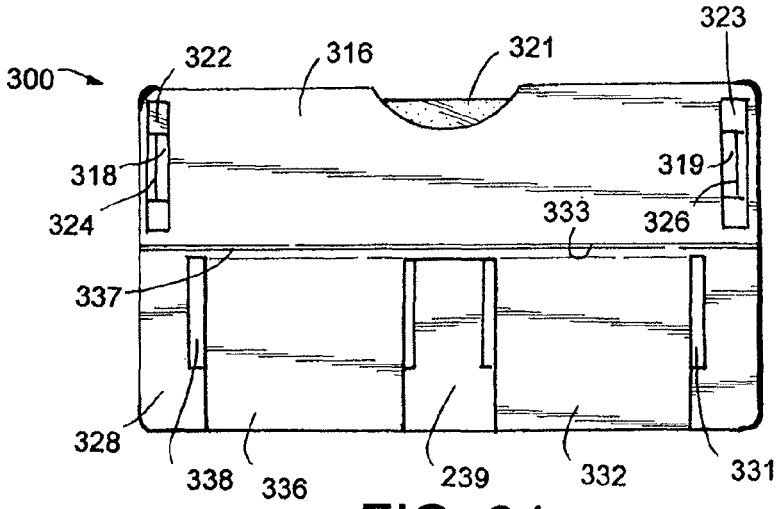
FIG. 24 is a rear elevational view of FIG. 19.
Figure 25:
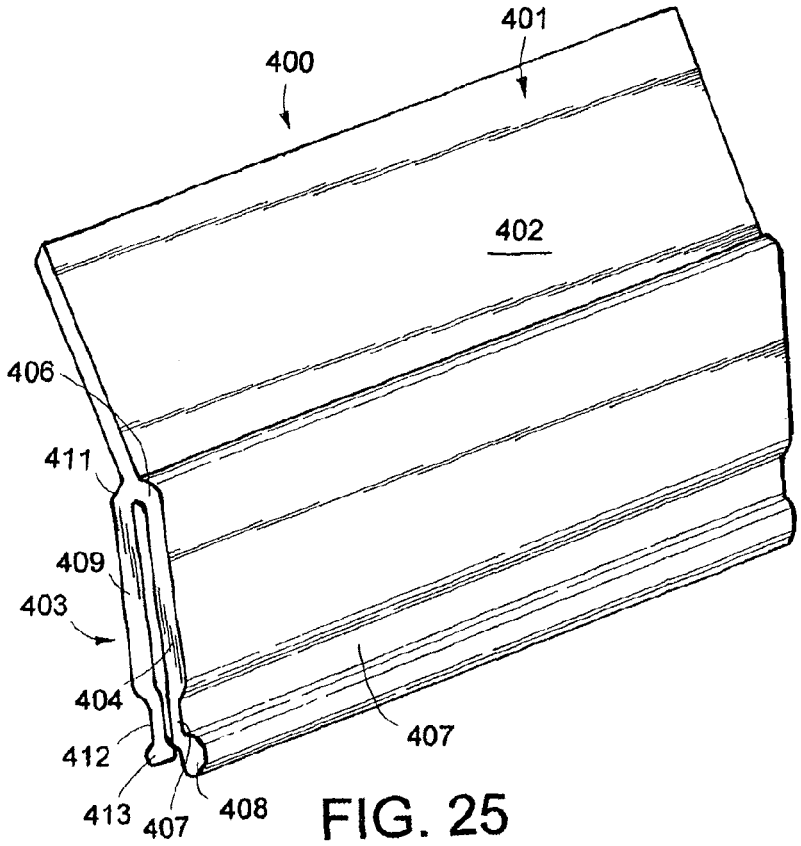
FIG. 25 is a perspective view of an alternative modification of an index tab of the invention for a file folder.
Figure 26:
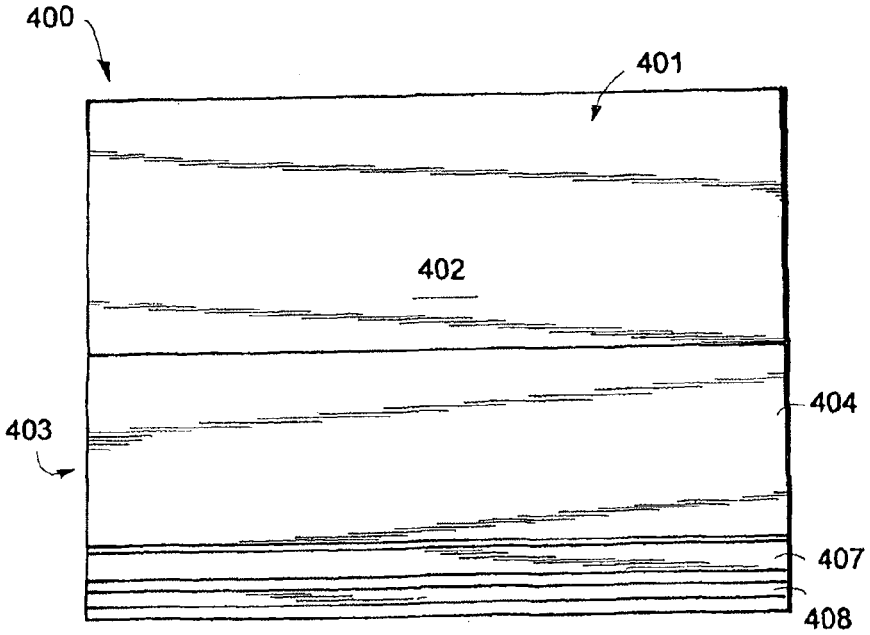
FIG. 26 is a front elevational view of FIG. 25.
Figure 27:
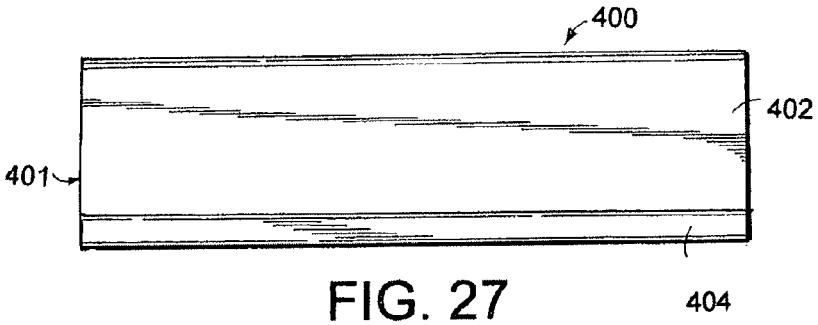
FIG. 27 is a top plan view of FIG. 25.
Figure 28:
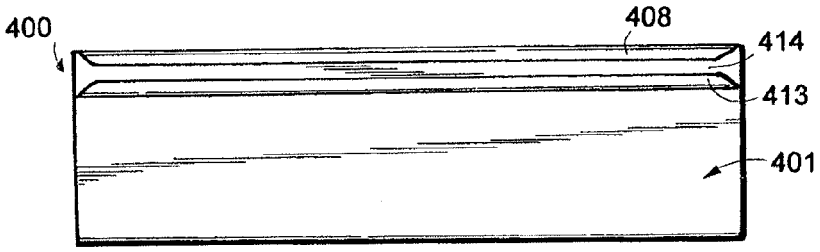
FIG. 28 is a bottom plan view of FIG. 25.
Figure 29:
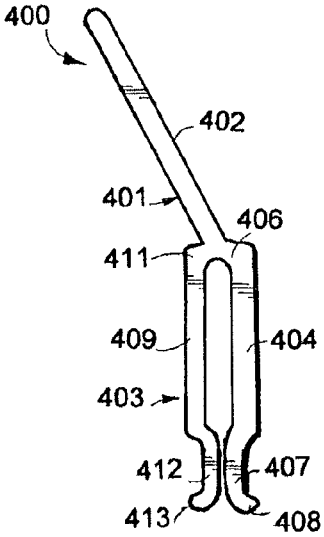
FIG. 29 is a side elevational view of FIG. 25.
Figure 30:
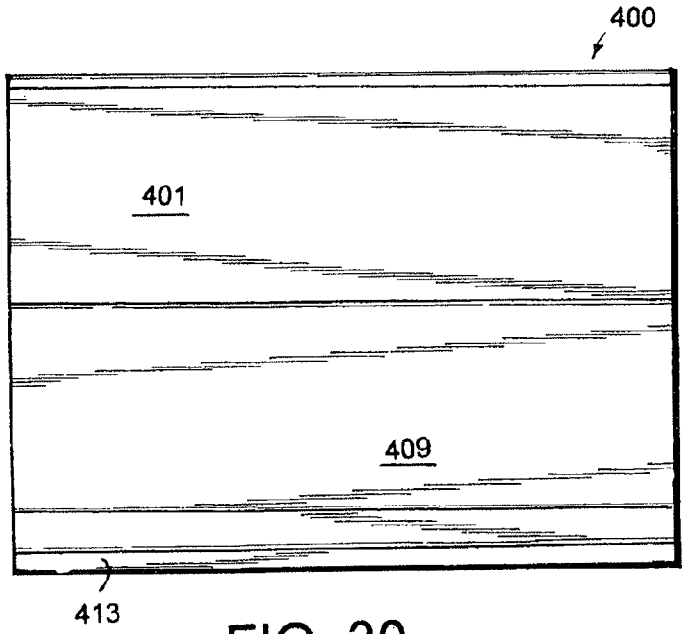
FIG. 30 is a rear elevational view of FIG. 25.

An index tab holder 10, shown in FIGS. 1 to 6, includes a generally rectangular body 11 having front side members 12 and 13 joined to a horizontal front member or base 14. Side members 12 and 13 and base 14 are joined to a flat back wall 16. As shown in FIG. 6, back wall 16 has a semi-circular notch 17 and upright end slots 18 and 19. A transparent sheet member or window 21 extends between side members 12 and 13 on top of back wall 16. Window 21 is a flat rectangular transparent plastic sheet having ears 22 and 23 extended from its opposite ends. As seen in FIG. 6, ears 22 and 23 extend into slots 18 and 19 under ledges 24 and 26 to retain window on back wall 16. A sheet of paper or plastic tab containing index data, numbers or a bar code (not shown) can be located between back wall 16 and window 21 to provide index information. A support 27 joined to base 14 is adapted to mount index tab holder 10 on a file folder. The file folders are conventional 9 by 12 inch paper hanging file folders having horizontal top sections accommodating metal bars. Opposite ends of the bars have downwardly open hooks for retaining the file folders in file drawers or on horizontal support rods. Support 27 has a generally rectangular front wall 28 joined to base 14 and extended downwardly from base 14. The angle between body 11 and support 27 is between 15 to 20 degrees. Other angles and a vertical alignment between body 11 and support 27 can be used. The inside bottom of wall 27 has a continuous inside lip 29 adapted to grip a file folder. As shown in FIGS. 1 and 2, wall 28 has a rectangular opening 31 open to a rectangular back wall 32. The top of back wall 32 is connected to base 14 with a horizontal live hinge 33 that retains back wall 32 adjacent front wall 28. The inside bottom edge of back wall 32 has a horizontal lip 34 aligned with lip 29 on front wall 28. When index tab holder 10 is mounted on a file folder lips 29 and 34 firmly engage opposite sides of either the front or rear wall of the file folder below the transverse file support bar. Index tab holder 10 can be located in positions along the top of the file folder without regard to slots or holes in the file folder. In use index tab holder 10 can be repositioned on the file folder without removing and remounting index tab holder 10 on the file folder. Index tab holder 10 is laterally moved along the top of the file folder to reposition index tab holder 10 on the file folder.

A first modification of the index tab holder of FIGS. 1 to 6 is shown in FIGS. 7 to 12 and indicated generally at 100. The parts of index tab holder 100 that correspond to the same parts of index tab holder 10 have the same reference number with the prefix 1. Plastic sheet member 121 has a irregular surface or a surface that allows application of graphite, carbon, pencil or ink information and designs. A separate tab is not required to identify the file folder.

A second modification of the index tab holder of FIGS. 1 to 6 is shown in FIGS. 13 to 18 and identified generally at 200. The parts of index tab holder 200 that correspond to the same parts of index tab holder 10 have the same reference numbers with the prefix 2. Support 227 has two back walls 232 and 236 connected to the bottom of base 214 with live hinges 233 and 237. Back wall 232 extends downwardly from live hinges 233 under rectangular opening 231. Back wall 236 extends downwardly from live hinge 237 under rectangular opening 238. Front wall 228 has a center section 239 separating openings 231 and 238. Window 221 is longer than window 21 to accommodate a larger tab with more file data, numbers and a bar code. Lips 234 and 229 and corresponding lips on walls 228 and 236 grip opposite sides of either the front or rear wall of the file folder below the transverse file support bar. The lips allow the index tab holder 210 to be repositioned along the top of the file folder without removing and remounting the index file holder on the file folder.

A third modification of the index tab holder, shown in FIGS. 19 to 24, is identified generally at 300. The parts of index tab holder 300 that corresponds to the same parts of index tab holders 10 and 200 have the same reference numbers with the prefix 3. Plastic sheet member 321 has an irregular surface or a surface that allows application of graphite, carbon, pencil or ink information and designs. A separate tab is not required to identify the file folder.

Figure 31:
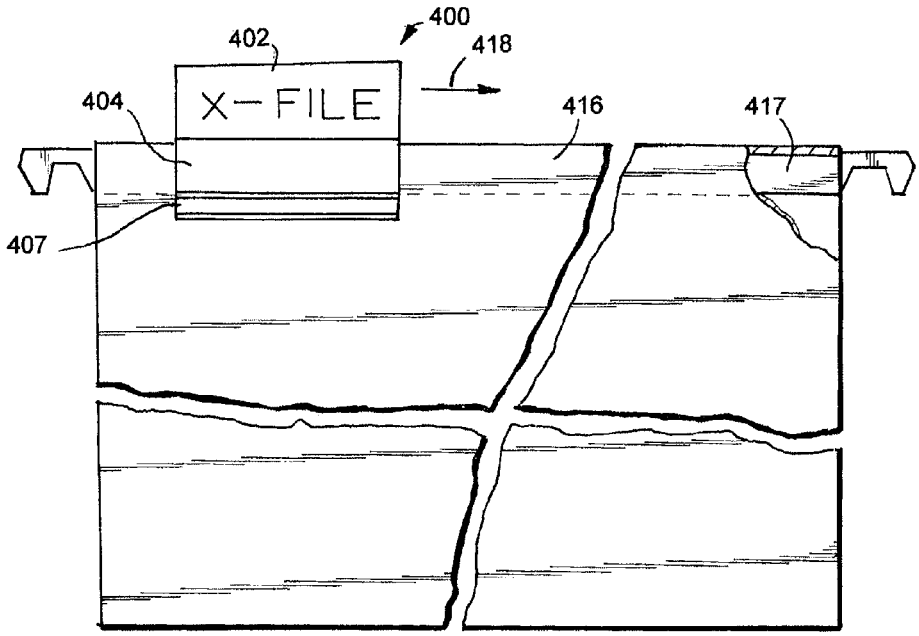
FIG. 31 is a fragmentary front elevational view of a file folder with the index tab of FIG. 25 mounted thereon.
Figure 32:
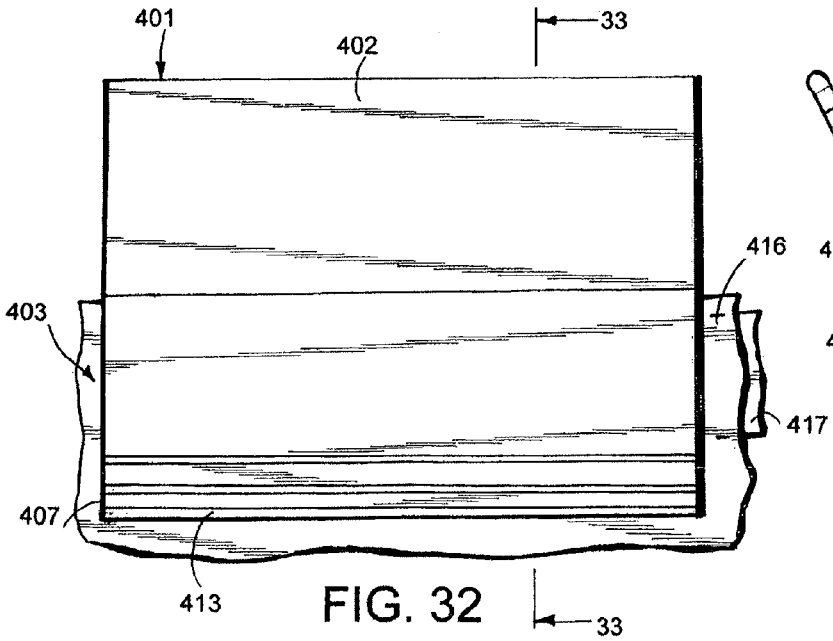
FIG. 32 is an enlarged front elevational view of the index tab of FIG. 31.
Figure 33:
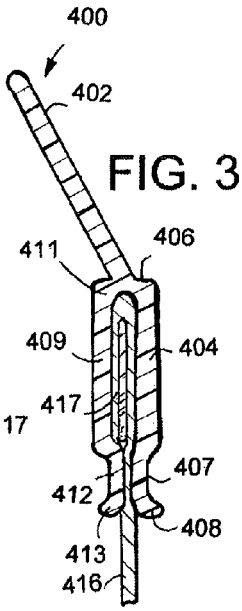
FIG. 33 is a sectional view taken along line 33-33 of FIG. 32.

A file folder index tab indicated generally at 400 is shown in FIGS. 25 to 30. Tab 400 is mounted on a hanging file folder in FIGS. 31 to 33. Index tab 400 is a one-piece plastic member having a flat rectangular body 401 with a flat outside surface 402 adapted to hold tape containing a bar code or other file indicating readable data. Data can be applied directly to surface 402. A pair of downwardly extended legs 404 and 409 are joined to the bottom of body 401 with linear live hinges 406 and 411. The lower end of leg 404 has an inwardly directed linear foot 407 terminating in an outwardly projected toe 408. Leg 409 extends downwardly generally parallel to leg 404. The lower end of leg 409 has a linear foot 412 opposite foot 407. An outwardly extended toe 413 is joined to the lower end of foot 412. Toes 408 and 413 diverge outwardly forming a mouth 414 for guiding support 403 over the top of file folder 416 and support bar 417. Body 401 extends upwardly and rearwardly at an angle of between 10 to 30 degrees relative to a vertical plane. Other angles including a linear alignment of body 401 with legs 404 and 409 can be used for the relative locations of body 401 to legs 404 and 409. As shown in FIG. 33, feet 407 and 412 are in surface gripping contact with opposite sides of file folder 416 below support bar 417. Index tab 400 can be repositioned along the horizontal length of file folder 416 by laterally sliding index tab 400, shown by arrow 418, along the top of file folder 416. Index tab 400 is not removed from file folder 416 as it is laterally moved to a new location on the file folder 416.

A combined hanging file folder and index tab holder indicated generally at 500 is shown in FIGS. 34 to 36. File folder 501 is a conventional hanging file folder having heavy paper or plastic walls 502 with metal hanger bars 503. An inverted U-shaped cross section body 504 is clamped around a top or upper section of file folder 501. Body 504 has downwardly extended legs 506 and 507 terminating in inwardly projected linear toes or hooks 508 and 509 that grip opposite sides of folder wall 502. As shown in FIG. 34, body 504 extends the entire length of the top of file folder 501. Body 504 can be secured with an adhesive to the top of file folder 501. Linear rails 510 extend along the top of body 504. As shown in FIG. 36, four parallel linear rails 510 are laterally spaced from each other and extend along the entire length of body 504. Stops or barriers 511 at opposite ends of rails 510 prevent a tab holder 512 from separating from rails 510. Tab holder 512 has a plurality of downwardly extended linear ribs 513 and grooves that cooperate with rails 510 to slidably mount tab holder 512 on body 504 for movement in opposite directions shown by arrows 517 and 518 to laterally position tab holder 512 in selected positions on file folder 501. Ribs 513 snap into the grooves between rails 511 to retain tab holder 512 on body 504. Tab holder 512 has a transverse flat pocket 514 for accommodating a tab 516. Tab holder 512 is a transparent plastic member to allow visual viewing of data on tab 516.

Figure 37:
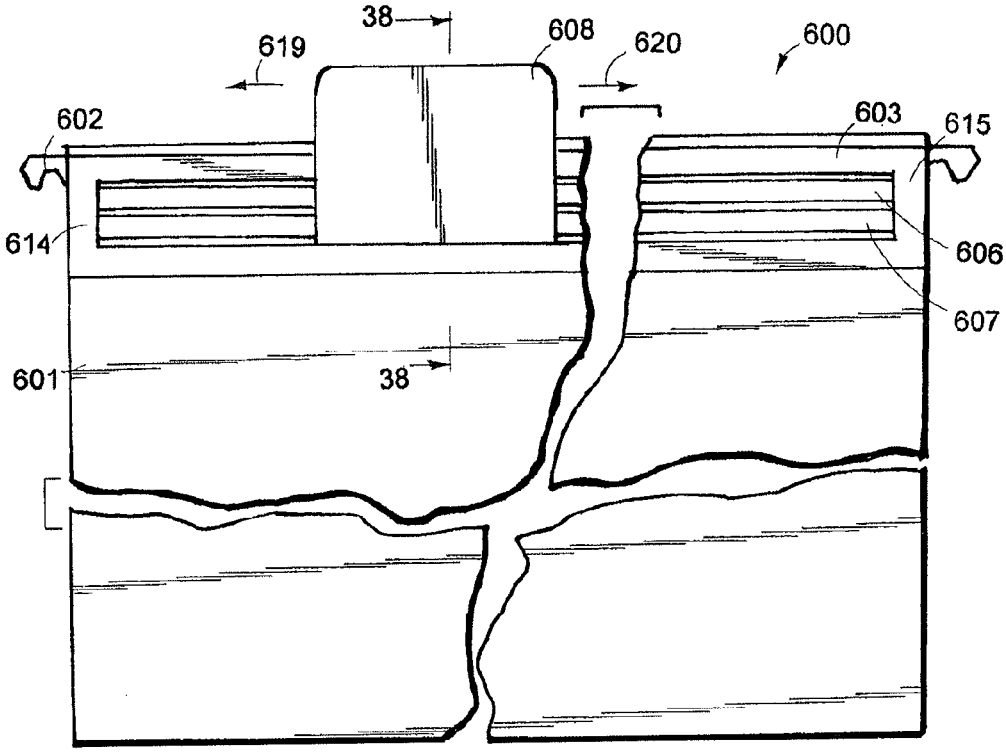
FIG. 37 is a fragmentary front elevational view of a file folder with a modification of an index tab holder mounted thereon.
Figure 38:
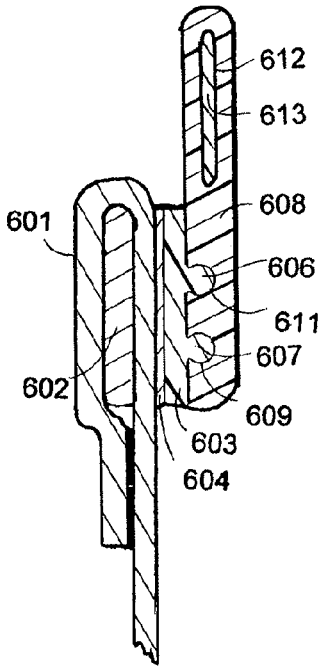
FIG. 38 is an enlarged sectional view taken along line 38-38 of FIG. 37.

A first modification of a combined file folder and index tab holder, indicated generally at 500, is shown in FIGS. 37 and 38. File folder 601 has a top section accommodating a hanging support bar 602. A body 603 comprising a generally flat band is secured with an adhesive 604 to the top section of file folder 601. Body 603 has two rails 606 and 607 extended outwardly along the length of body 603. Stops or barriers 614 and 615 at opposite ends of rails 606 and 607 prevent an index tab holder from separating from rails 606 and 607. Index tab holder 608 has parallel linear grooves 609 and 611 that accommodate rails 606 and 607 and allow index tab holder 608 to be laterally moved along body 603, shown by arrows 619 and 620, without removing the index tab holder 608 from body 603. Index tab holder 608 snaps onto rails 606 and 607 to retain index tab holder 608 in a generally upright position. The upper section of index tab holder 608 has a flat longitudinal pocket 612 accommodating a paper or plastic tab 613 containing file data. Pocket 612 has open ends to allow tab 613 to be inserted into and removed from the pocket.

Figure 39:
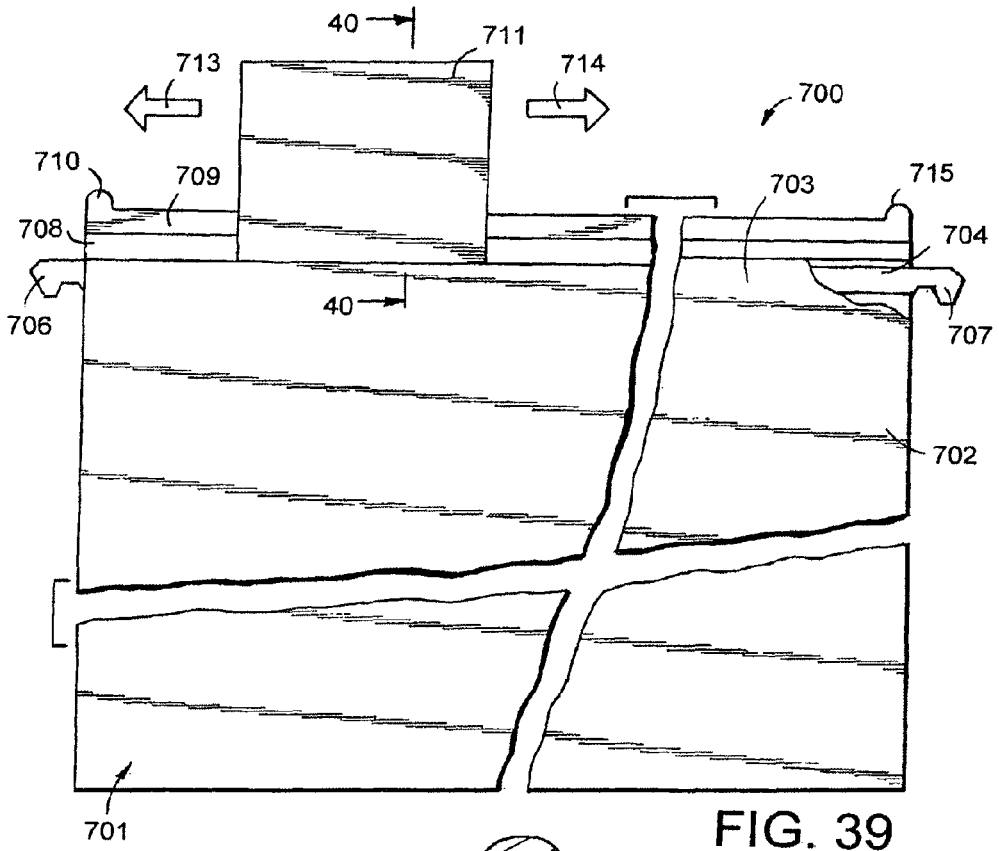
FIG. 39 is a fragmentary elevational view of a file folder with another modification of an index tab holder mounted thereon.
Figure 40:
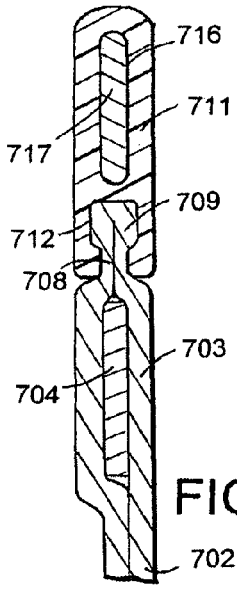
FIG. 40 is an enlarged sectional view taken along the line 40-40 of FIG. 39.

A second modification of a combined file folder and index tab holder, indicated generally at 700, is shown in FIGS. 39 and 40. File folder 701 has paper or plastic walls 702 folded upwardly to accommodate documents. Each wall terminates in a horizontal top section 703 turned over a metal support bar 704 having downwardly open hooked ends 706 and 707. The paper or plastic material of one wall above bar 704 is compressed into a neck 708 and head 709 along the length of the top of file folder 701. Head 709 is a linear rail along the top of file folder 701. Head 709 has a generally square cross section and a width greater than the width of neck 708. Stops or barriers 710 and 715 at opposite ends of head 709 prevent an index tab holder 711 from separating from the head 709. Index tab holder 711 has a recessed groove 712 that accommodates head 709 and neck 708 with a firm slide fit which allows index tab holder 711 to be laterally moved, shown by arrows 713 and 714, along the length of head 709 without removing index tab holder 711 from head 709. The upper section of index tab holder 711 has a flat longitudinal pocket 716 accommodating a paper or plastic index tab 717 containing file data.

Figure 41:
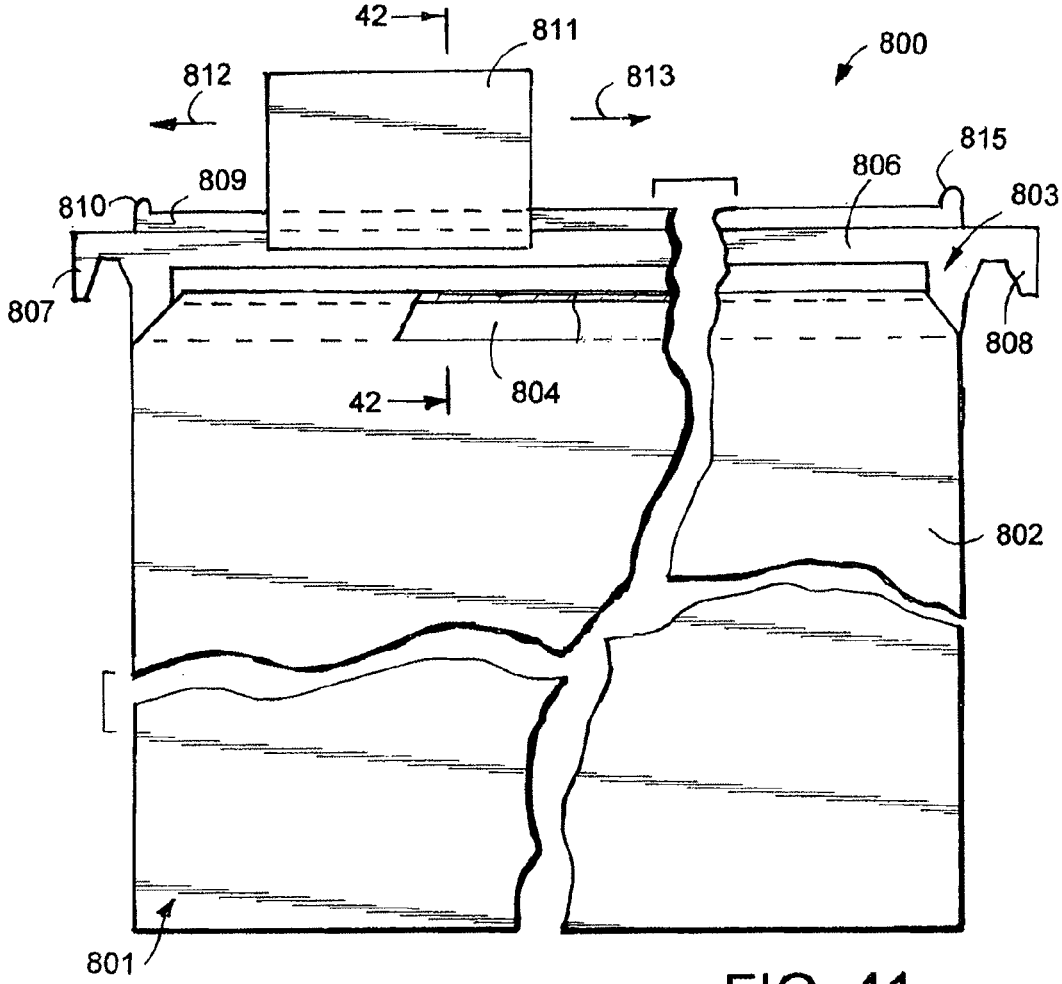
FIG. 41 is a fragmentary front elevational view of a file folder with a third modification of an index tab holder mounted thereon.
Figure 42:
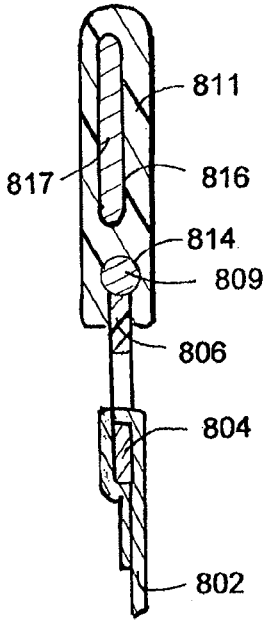
FIG. 42 is an enlarged sectional view taken along line 42-42 of FIG. 41.
Figure 43:
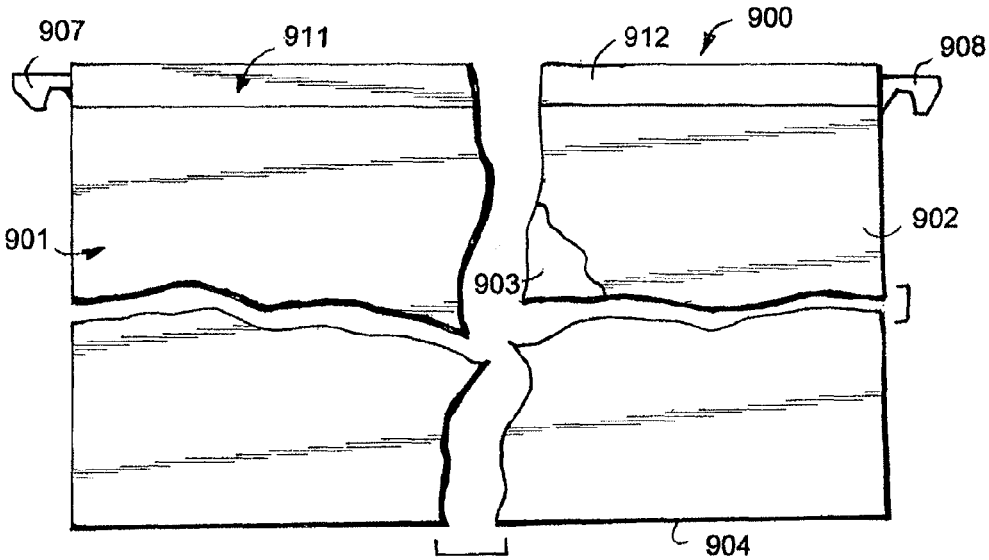
FIG. 43 is a fragmentary front elevational view of a hanging file folder having another modification of an index tab holder mounted thereon.
Figure 44:
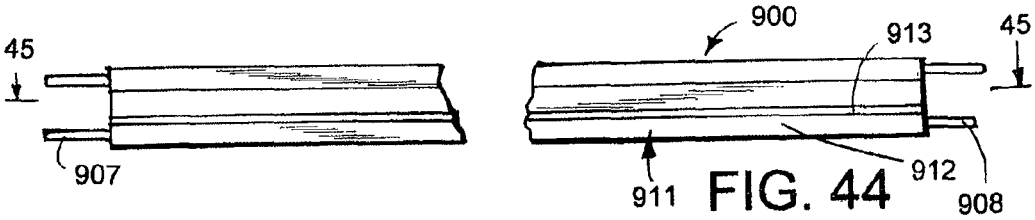
FIG. 44 is a fragmentary top plan view of FIG. 43.

A third modification of a combined file folder and index tab holder, indicated generally at 800, is shown in FIGS. 41 and 42. File folder 801 has paper or plastic walls 802 folded upwardly to accommodate documents. A file hanger 803 supports walls 802 generally upright in a file drawer. Hanger 803 has a lower flat bar 804 and an upper flat bar 806. The upper end of wall 802 is turned about bar 804 to connect file folder 801 to hanger 803. Downwardly open hooks 807 and 808 are located on opposite ends of bar 806. A linear rod 809 having a diameter larger than the width of bar 806 is secured to the top of bar 806. Rod 809 is a linear rail attached to the top of hanger 803 for guiding index tab holder 811 along the rail. Rod 809 is a cylindrical member. Rod 809 can be square or triangular members. Stops or barriers 810 and 815 on opposite ends of rod 809 prevent index that holder from separating from rod 809. Index tab holder 811 is laterally movable, shown by arrows 812 and 813, along the top of hanger 803 to change the position of index tab holder 811 on file folder 801. Index tab holder 811 is a generally flat transparent plastic member having a bottom key hole shaped groove 814 accommodating a section of rod 809 and upper bar 806. Index tab holder 811 is forced downwardly to snap rod 809 into groove 814 to mount index tab holder 811 on hanger 803. Index tab holder 811 has a longitudinal flat pocket 816 accommodating a paper or plastic tab 817 containing file data.

Figure 45:
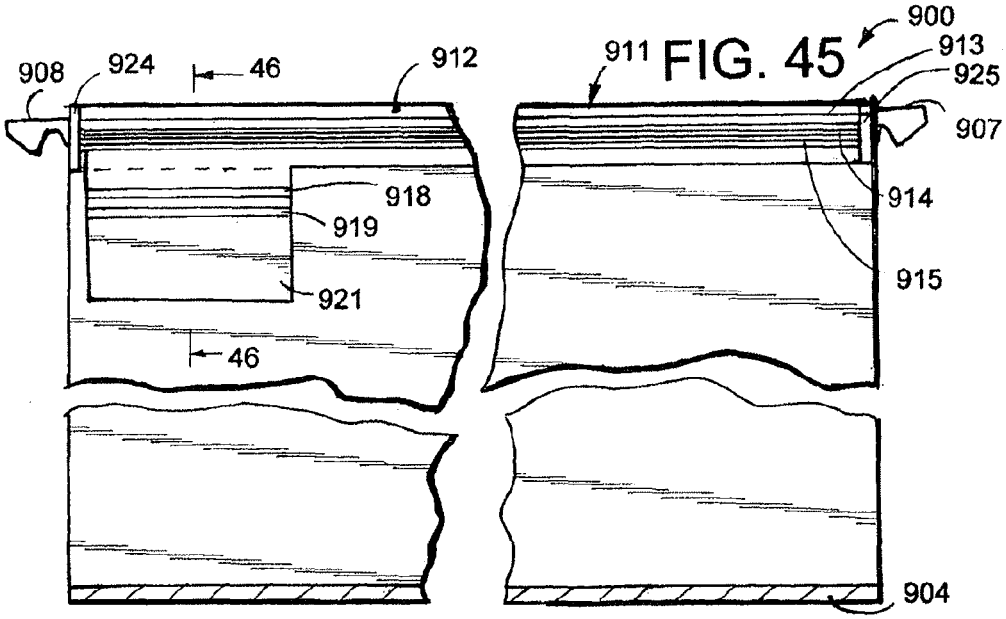
FIG. 45 is a fragmentary sectional view taken along the line 45-45 of FIG. 43.
Figure 46:
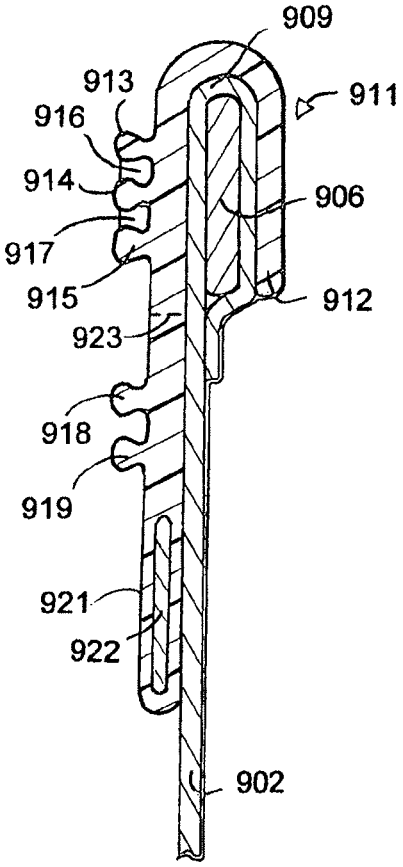
FIG. 46 is an enlarged sectional view taken along line 46-46 of FIG. 45.
Figure 47:
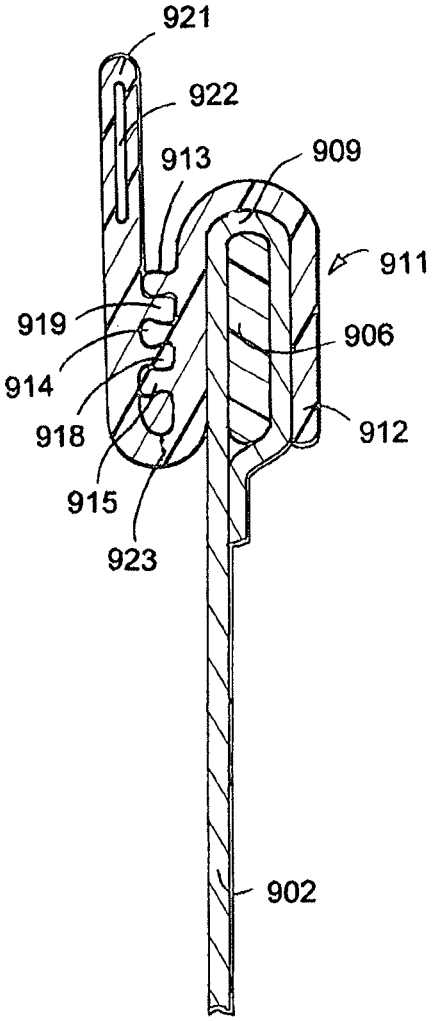
FIG. 47 is a sectional view corresponding to FIG. 46 with the index tab in the upright viewing position.

A fourth modification of a combined hanging file folder and index tab holder, indicated generally at 900, is shown in FIGS. 43 to 47. File folder 901 has paper or plastic front and rear walls 902 and 903 joined at a bottom fold or hinge section 904. A file hanger 906 supports walls 902 and 903 generally upright on side ledges of a conventional file drawer (not shown). Hanger 906 is flat metal bar having downwardly directed open hooks 907 and 908 on opposite ends of the bar. Hooks 907 and 908 support file folder 901 on the ledges of the file drawer. As shown in FIGS. 46 and 47, the upper end 909 of wall 902 is turned over hanger 906 to secure hanger 906 to file folder 901.

An index tab holder 911 mounted on the top of wall 902 has a transverse inverted U-shaped or channel member 912. Member 912 can be secured to upper end 909 of wall 902 with an adhesive. Alternatively, channel member 912 can be clamped on upper end 909 of wall 902. Member 912 has continuous transverse linear ribs 913, 914 and 915 and transverse grooves 916 and 917 between adjacent ribs. Ribs 913, 914 and 915 have enlarged ends providing grooves 916 and 917 with generally key-hole shapes to accommodate linear rails 918 and 919. As shown in FIG. 47, rails 918 and 919 snap into grooves 916 and 917 with a slide fit with ribs 913, 194 and 915. The outer or free end 921 of channel members 912 has a transverse flat slot accommodating a tab 922 adapted to contain visual information indicating the contents retained in the file folder. The middle section of end 921 has a transverse live hinge 123 allowing end 921 to be turned upright and locked onto ribs 913, 914 and 915.

Live hinge 923 can be cut whereby index tab holder 911 can be repositioned along channel member 912. As shown in FIG. 45, the opposite ends of channel member 912 has stops or projections 924 and 926 at the ends of ribs 913, 194 and 915. Stops 924 and 926 prevent index tab holder 911 from being laterally removed from channel member 912.

The index tab holders, index tab and combined file folder and index tab have been shown and described with hanging file folders. The index tab holders and index tab can be used with notebook dividers and document dividers. Changes in the parts and arrangement of parts of the index tab holders, index tabs, and combined file folders and index tab holders and materials may be made by a person skilled in the art without departing from the invention.

The invention claimed is:

1. A combined file folder and tab holder, comprising:

a folder having an upright wall with an upper portion, a hanger bar having a bar portion, a first downwardly open hook end, and a second downwardly open hook end, wherein the hanger bar is secured to the upright wall and wherein the upper portion is folded over at least a portion of the bar portion of the hanger bar forming a top surface; and a tab holder having a first portion and a second portion, wherein:

the second portion comprises a first extended leg and a second extended leg each joined to the first portion with at least one live hinge;

each of the first and second extended legs has at least one inwardly directed structure, wherein the at least one inwardly directed structure from the first extended leg is generally aligned with the at least one inwardly directed structure from the second extended leg;

the first and second extended legs are in opposing position and adapted to engage opposite sides of the upright wall of the folder; and each of the at least one live hinges is adapted and arranged to allow the respective first or second extended leg to flexibly pivot about its respective hinge relative to the first portion and relative to the opposing second or first extended leg, respectively, thereby enabling a user to slide the tab holder along the top surface without removing the tab holder from the file folder.

2. The combined file folder and tab holder of claim 1, wherein the first portion is adapted to receive indicia.

3. The combined file folder and tab holder of claim 1, wherein the at least one inwardly directed structure from the first extended leg is generally aligned at substantially the same distance from the live hinge with the at least one inwardly directed structure from the second extended leg.

4. The combined file folder and tab holder of claim 1, wherein the first extended leg and the second extended leg each have a length measured parallel to their respective live hinges between a first end and a second end.

5. The combined file folder and tab holder of claim 4, wherein the length of the first extended leg and the second extended leg is substantially the same.

6. The combined file folder and tab holder of claim 4, wherein the first and second extended legs each include first and second boundary edges at respective first and second ends, the first boundary edge of the first extended leg being substantially aligned with the first boundary edge of the second extended leg and the second boundary edge of the first extended leg being substantially aligned with the second boundary edge of the second extended leg.

7. The combined file folder and tab holder of claim 1, wherein the lower end of at least one of the first and second extended legs includes an outwardly extended toe.

8. The combined file folder and tab holder of claim 7, wherein the lower end of both the first and second extended legs includes an outwardly extended toe.

9. The combined file folder and tab holder of claim 7, wherein the lower ends of the first and second extended legs define a mouth for guiding support over the top surface and hanging bar of the folder.

10. A tab holder for use with a hanging file folder, the tab holder comprising:

a first portion adapted to receive indicia for identifying the hanging file folder; and a second portion adapted to engage a top surface of the hanging file folder and enable a user to slide the tab holder along the top surface without removing the tab holder from the file folder, the second portion comprising a first extended leg and a second extended leg each joined to the first portion with at least one live hinge adapted and arranged to allow the respective first or second extended leg to flexibly pivot about its respective hinge relative to the first portion and relative to the opposing second or first extended leg, respectively, wherein:

each of the first and second extended legs have at least one inwardly directed structure and the at least one inwardly directed structure from the first extended leg is generally aligned with the at least one inwardly directed structure from the second extended leg; and the first and second extended legs are adapted to engage opposite sides of an upright wall of the hanging file folder.

11. The tab holder of claim 10, wherein the at least one inwardly directed structure from the first extended leg is generally aligned at substantially the same distance from the live hinge with the at least one inwardly directed structure from the second extended leg.

12. The tab holder of claim 10, wherein the first extended leg and the second extended leg each have a length measured parallel to their respective live hinges between a first end and a second end.

13. The tab holder of claim 12, wherein the length of the first extended leg and the second extended leg is substantially the same.

14. The tab holder of claim 12, wherein the first and second extended legs each include first and second boundary edges at their respective first and second ends, the first boundary edge of the first extended leg being substantially aligned with the first boundary edge of the second extended leg and the second boundary edge of the first extended leg being substantially aligned with the second boundary edge of the second extended leg.

15. The tab holder of claim 10, wherein the lower end of at least one of the first and second extended legs includes an outwardly extended toe.

16. The tab holder of claim 15, wherein the lower end of both the first and second extended legs includes an outwardly extended toe.

17. The tab holder of claim 16, wherein the lower ends of the first and second extended legs define a mouth for guiding support over the top surface of the hanging file folder.

18. The tab holder of claim 10, wherein when the tab holder is arranged on the top surface of the hanging file folder, flexibly pivoting the first portion and the first extended leg relative to one another about the respective at least one live hinge causes the second extended leg and the at least one inwardly directed structure of the second extended leg to separate from a surface of the hanging file folder.

* * * * *